US005954029A

United States Patent [19]

Peters et al.

[11] Patent Number: 5,954,029

[45] Date of Patent: Sep. 21, 1999

[54] UNIT FUEL INJECTOR HAVING CONSTANT START OF INJECTION

[75] Inventors: Lester L. Peters; Julius P. Perr; Bai Mao Yen, all of Columbus, Ind.

[73] Assignee: Cummins Engine Company, Inc., Columbus, Ind.

[21] Appl. No.: 08/377,939

[22] Filed: Jan. 25, 1995

[51] Int. Cl.[6] ..... F02M 37/04

[52] U.S. Cl. ..... 123/446; 123/299; 123/496

[58] Field of Search ..... 123/501, 502, 123/446, 447, 496, 299, 300; 239/88–96

[56] References Cited

U.S. PATENT DOCUMENTS

| | | | |
|---|---|---|---|
| 2,225,019 | 12/1940 | Retel . | |
| 2,922,581 | 1/1960 | Garday . | |
| 3,348,488 | 10/1967 | Wolff . | |
| 3,438,359 | 4/1969 | Thoma | 123/300 |
| 3,951,117 | 4/1976 | Perr . | |
| 4,402,456 | 9/1983 | Schneider . | |
| 4,463,725 | 8/1984 | Laufer | 123/446 |
| 4,463,901 | 8/1984 | Perr et al. . | |
| 4,471,740 | 9/1984 | Jourde et al. . | |
| 4,524,737 | 6/1985 | Hofman . | |
| 4,718,384 | 1/1988 | Takahashi . | |
| 4,782,803 | 11/1988 | Kikuchi . | |
| 4,975,029 | 12/1990 | Hatz | 123/299 |
| 5,020,979 | 6/1991 | Askew . | |
| 5,056,488 | 10/1991 | Eckert . | |
| 5,097,812 | 3/1992 | Augostin | 123/300 |
| 5,168,847 | 12/1992 | Grieshaber | 123/299 |
| 5,209,208 | 5/1993 | Siebert et al. . | |
| 5,219,280 | 6/1993 | Yashiro . | |
| 5,286,178 | 2/1994 | Schaef | 123/299 |

*Primary Examiner*—Carl S. Miller

*Attorney, Agent, or Firm*—Sixbey, Friedman, Leedom & Ferguson; Charles M. Leedom, Jr.; Donald R. Studebaker

[57] ABSTRACT

A fuel injector for periodically injecting fuel pulses of a variable quantity on a cycle to cycle basis as a function of the pressure of fuel supplied to the injector from a source of fuel and at a constant time during each cycle is set forth including an injector body containing a central bore and an injection orifice at the lower end of the body and a reciprocating plunger assembly including an upper plunger section and a lower plunger section serially mounted within the central bore to define a variable volume metering chamber located between the lower plunger section and the lower end of the injector body containing the injection orifice. The variable volume metering chamber communicates during a portion of each injector cycle with the source of fuel. A variable volume timing chamber is located between the upper and lower plunger sections, and the timing chamber communicates for a portion of each injector cycle with the source of timing fluid and os isolated from the source of timing fluid at a constant time during each cycle.

24 Claims, 11 Drawing Sheets

UNIT FUEL INJECTOR HAVING CONSTANT START OF INJECTION

TECHNICAL FIELD

This invention relates to a unit fuel injector designed to inject fuel pulses of variable quantity into the cylinder of an internal combustion engine with the start of injection being constant.

BACKGROUND ART

The design of a commercially competitive fuel injector normally involves acceptance of some characteristics which are less than optimal since the basic goals of low cost, high performance and reliability are often in direct conflict. For example, cam operated unit injectors, such as disclosed in U.S. Pat. No. 3,544,008, are more expensive to construct but are more reliable and accurate than are distributor-type fuel injector systems having a single centralized high pressure pump and a distributor valve for metering and timing fuel flow from the pump to each of a plurality of injection nozzles as disclosed in U.S. Pat. No. 3,557,765.

As the need for higher engine efficiency and pollution abatement have increased, it has become increasingly evident that some economical means must be provided to have constant injector timing in response to changing engine operation conditions. Such control is relatively straight forward in distributor-type fuel injector systems since the injection event is controlled at one central location. However, in unit injector systems, providing constant injector timing while varying the metered quantity of fuel ordinarily requires modification of each individual unit injector, thereby adding significantly to the overall cost of the system.

U.S. Pat. Nos. 2,997,994 and 2,863,438 provide examples of attempts to solve this dilemma. In particular, these patents disclose the use of a collapsible hydraulic link to selectively change the effective length of the cam operated fuel injector plunger. However, the simplicity of these hydraulic timing controls is only achieved by operating the hydraulic link in either a fully expanded or fully collapsed mode. Thus there is a stepped change in timing of the injection event which will not necessarily suit the broad range of conditions normally encountered during the operation of an engine. Attempts to provide for variations in the start of injection, even when a hydraulic link is employed, have generally involved the use of a mechanical rack which controls the size and/or the point of collapse of the hydraulic link. Examples of such hydraulic/mechanical systems are disclosed in U.S. Pat. Nos. 3,847,510 and 4,092,964.

Hydraulic arrangements are often used for providing infinite variation of unit injector timing as illustrated in U.S. Pat. Nos. 3,035,523 and 3,083,912 wherein fairly complex hydraulic arrangements for this purpose are disclosed. However, in these systems the quantity injected and the change in timing are interrelated and may not be controlled independently of one another. Moreover, the timing of injection varies with each stroke.

Other types of injectors employing a hydraulic link which may effect injector timing have been disclosed such as in Danish Patent No. 56,902 issued Nov. 6, 1939 and U.S. Pat. Nos. 3,029,737 and 3,782,864. However, these additional disclosures do not teach how to achieve constant start of injection while varying the quantity of fuel injected. Similarly, U.S. Pat. No. 4,463,901 discloses the use of a hydraulic link for relating the timing and metering chambers to one another, however, again this disclosure does not utilize such linkage to achieve constant start of injection while varying the quantity of fuel injected.

Presently, fuel injection systems for achieving constant start of injection utilize various valving arrangements or distributor configurations. However, due to time delays and pressure waves in the fuel lines, the start of injection retards with engine speed.

In short, the prior art fails to disclose a low cost, highly reliable fuel injector which provides constant start of injection while varying the metered quantity of fuel injected.

SUMMARY OF THE INVENTION

The basic object of this invention is to overcome the deficiencies of the prior art by providing a fuel injector for periodically injecting fuel pulses of a variable quantity on a cycle to cycle basis wherein the quantity of fuel injected is independent of the timing of each injection.

Another more specific object of this invention is to provide a fuel injector including an injector body containing a central bore in which is mounted a lower plunger section and an upper plunger section to define separate timing and injection chambers.

Still a further object of the subject invention is to provide an injector body containing a timing fluid supply passage and a timing fluid drain passage, wherein the passages are positioned to cause timing fluid to pass into the timing chamber when the upper plunger section is adjacent its uppermost position within the injector body and to cause timing fluid to be discharged from the timing chamber until such time as injection is to be commenced.

Another object of the subject invention is to provide an injector body containing the passages as described above in combination further with a fuel drain passage positioned to cause fuel in the timing chamber to be spilled to a fluid drain when the lower plunger section is adjacent its lowermost position within the injector body.

A still more specific object of the subject invention is to provide a fuel injector for periodically injecting fuel pulses of a variable quantity on a cycle to cycle basis as a function of the pressure of fuel supplied to the injector from a source of fuel and at a constant time during each cycle including an injector body containing a central bore and an injection orifice at the lower end of the body and a reciprocating plunger assembly including an upper plunger section and a lower plunger section serially mounted within the central bore to define a variable volume metering chamber located between the lower plunger section and the lower end of the injector body containing the injection orifice. The variable volume metering chamber communicates during a portion of each injector cycle with the source of fuel. A variable volume timing chamber is located between the upper and lower plunger sections, and the timing chamber communicates for a portion of each injector cycle with the source of timing fluid.

Still other and more specific objects of the invention will become apparent from a consideration of the following description of the preferred embodiment when read in light of the several figures.

DETAILED DESCRIPTION OF THE INVENTION

Figure 1A:
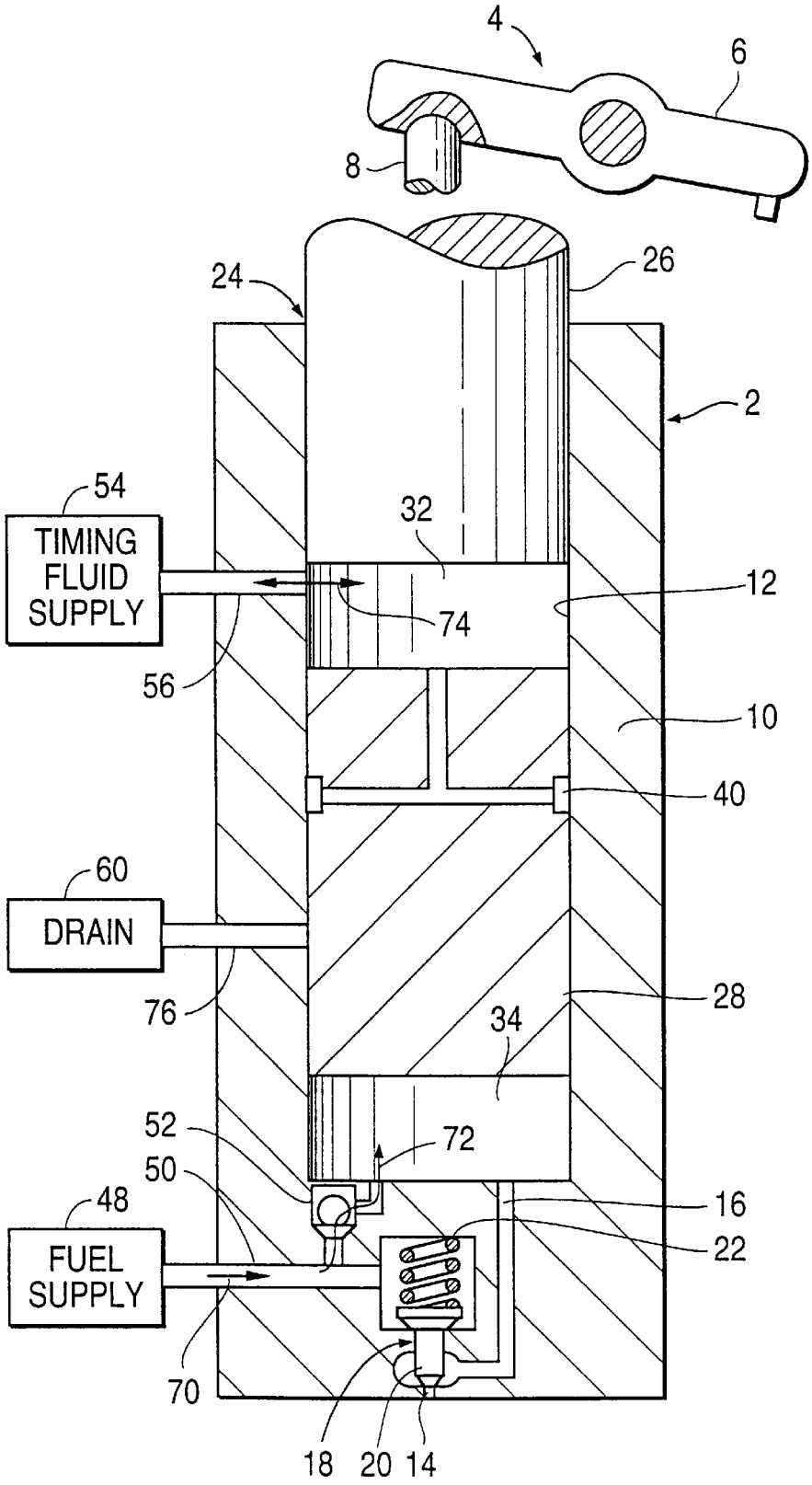
FIG. 1A is a cross sectional, schematic view of a fuel injector constructed in accordance with the subject invention including a cam actuated upper plunger section depicted in its uppermost position to allow fuel and timing fluid to flow into the injector.
Figure 1B:
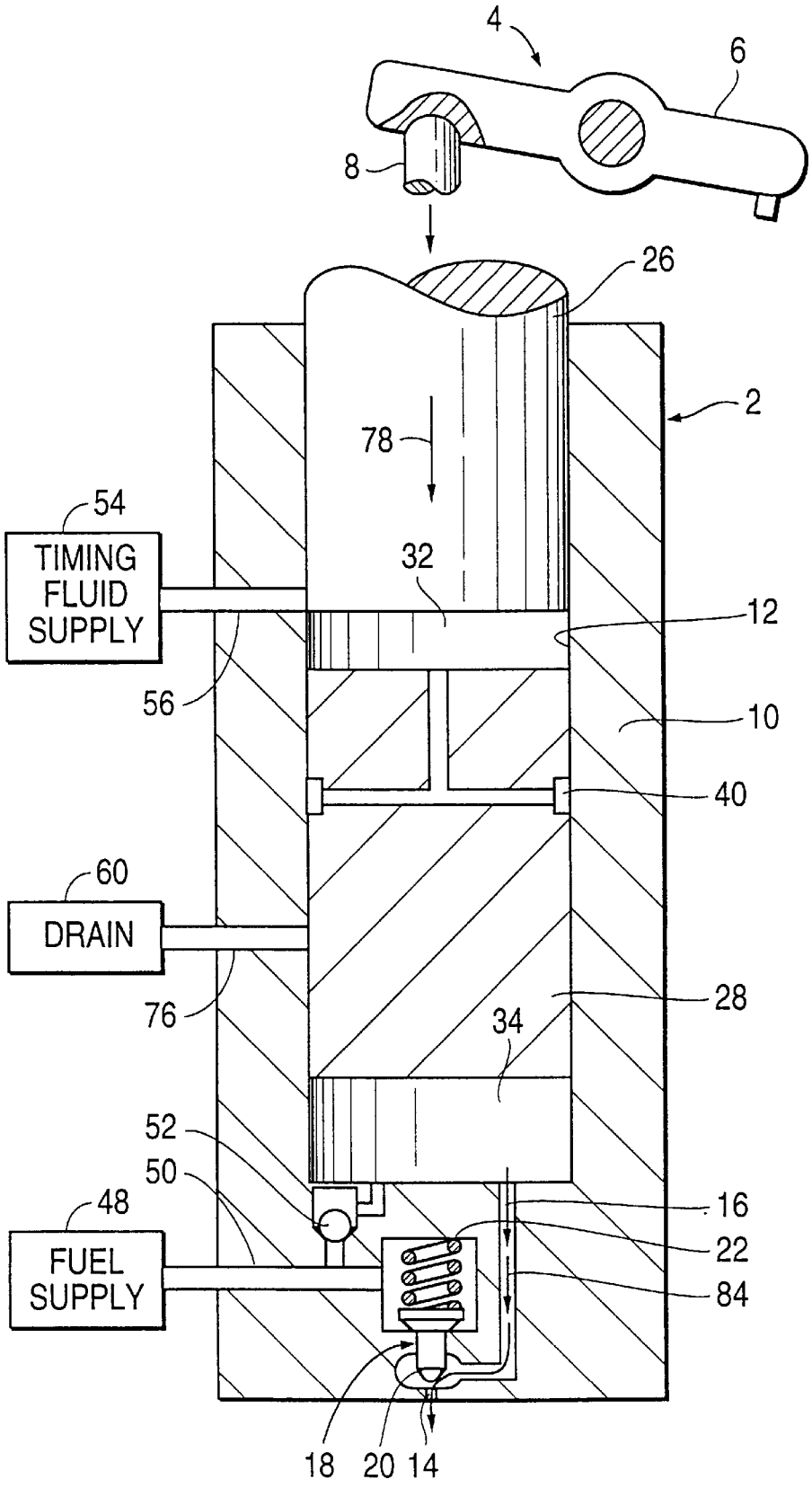
FIG. 1B is a cross sectional view of the injector illustrated in FIG. 1A wherein the upper plunger section has commenced a downward stroke to cause fuel metered into the metering chamber to be dispelled through the injector orifice.
Figure 1C:
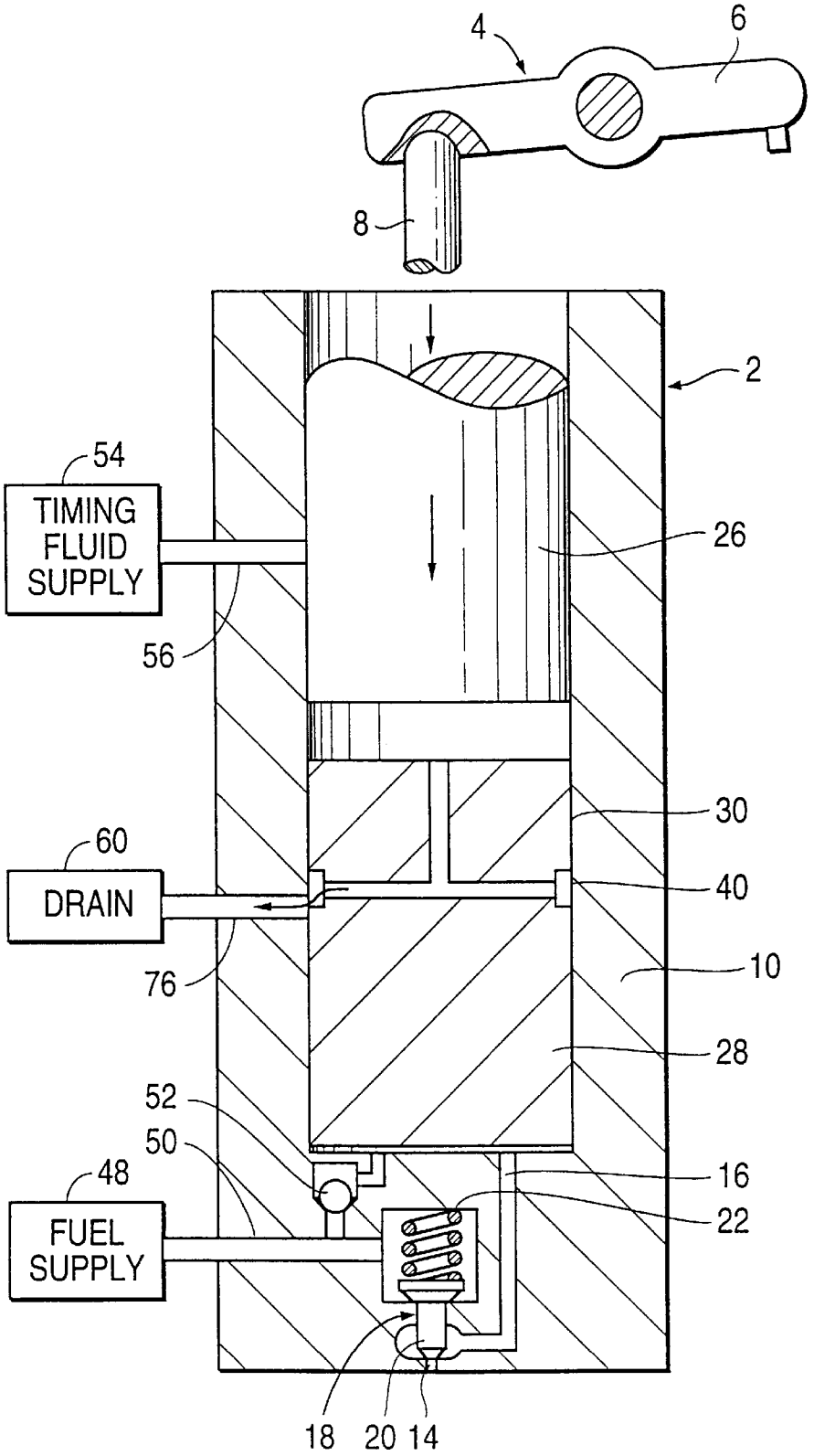
FIG. 1C is a cross sectional view of the injector illustrated in FIGS. 1A and 1B including a lower plunger section which has reached its lowermost position during the downward stroke of the upper plunger section and the timing fluid remaining in the timing chamber is being dispelled through a drain passage.

For purposes of providing a clear understanding of the basic principles of this invention, reference is initially made to FIGS. 1A through 1C illustrating a highly simplified schematic diagram of a fuel injector designed in accordance with the subject invention for use in supplying fuel pulses directly into the cylinder of an internal combustion engine. In particular, FIG. 1A discloses a fuel injector assembly 2 which is mechanically actuated by a cam (not illustrated) through an actuating mechanism 4 including a rocker arm 6 and push rod 8. Because the cam is normally mounted on the conventional cam shaft (not illustrated) of the internal combustion engine, the fuel pulses produced by the injector assembly 2 in accordance with the present invention carried out at a constant position of the cam surface thus resulting in a constant start of injection.

Referring more specifically to FIG. 1A, fuel injector assembly 2 includes an injector body 10 containing a central bore 12 and an injection orifice 14 located at the lower end of the injector body 10. In this description the words "upper" and "lower" will refer to the portions of the injector assembly which are, respectively, farthest away and closest to the engine cylinder when the injector is operatively mounted on the engine. Injection orifice 14 is positioned to communicate directly on one side with the interior of the engine cylinder and on the other side to communicate with the central bore 12 through an injection passage 16. As illustrated in FIG. 1A, injection orifice injection orifice 14 is normally closed by a tip valve assembly 18 including an axially slidable tip valve element 20 and a tip valve spring 22 which biases the tip valve element 20 into the position illustrated in FIG. 1A except when the pressure of fuel within passage 16 exceeds a predetermined level at which point the valve element 20 moves upwardly as illustrated in FIG. 1B to allow fuel to pass through injection orifice 14 into the engine cylinder. Controlling independently the amount and timing of fuel passage through orifice 14 is the purpose of the subject invention.

Mounted for reciprocal movement within central bore 12 of injector body 10 is plunger assembly 24 including an upper plunger section 26 and a lower plunger section 28. Upper plunger section 26 is mechanically biased upwardly by an injection spring (not illustrated) and is moved downwardly by push tube 8, rocker arm 6 and an injector cam (not illustrated). Lower plunger section 28 is mounted for reciprocal movement independent of the upper plunger section 26 in a manner to define a variable volume timing chamber 32 between the upper and lower plunger sections and a variable volume metering chamber 34 between the lower plunger section 28 and the lower end of injector body 10.

As further illustrated in FIG. 1A, fuel is provided to the injector assembly by a fuel supply 48 which is arranged to supply fuel to the metering chamber 34 by a fuel supply passage 50 containing a check valve 52 arranged to allow fuel to flow into the metering chamber 34 from fuel supply 48 but not in a reverse direction. As further illustrated in FIG. 1A, timing fluid may be supplied to timing chamber 32 from a timing fluid supply 54 through a timing fluid passage 56 which connects with the timing chamber 32 at a location adjacent the uppermost position of upper plunger section 26.

The timing fluid is supplied to the timing chamber 32 during the up stroke of the upper plunger section 26. It should be noted that timing fluid may be any suitable fluid including fuel itself. As the upper plunger 26 begins to descend, timing fluid in chamber 32 will be expelled back through passage 56 until such time as the upper plunger section 26 covers the passage 56 and thus forms a hydraulic link between the upper plunger section 26 and the lower plunger section 28. As can be seen from FIG. 1A, the lower plunger section 28 includes a drain passage 40 formed therein which communicates with the timing chamber 32 to expel pressurized fluid from the timing chamber 32 to the drain 60 when the drain passage 40 formed in the lower plunger section 28 aligns with the drain passage 76 formed in the injector body 10.

For an understanding of how the injector assembly 2 operates, reference will now be made to FIGS. 1A through 1C which depicts the disclosed assembly in various modes of operation. FIG. 1A shows the assembly during the period in which the upper plunger section 26 is caused to dwell in its uppermost position defined by a sector of the injector actuating cam (not illustrated) which has a circumferential extent which is sufficient to provide the time necessary to allow the proper amount of fuel to be metered into the metering chamber 34 and the requisite amount of timing fluid (which may also be fuel) to be metered into the timing chamber 32. The actual amount of fuel which flows into the metering chamber 34 as illustrated by arrow 70 and 72 may be controlled by varying the pressure (e.g. 10 PSI to 100 PSI) and preferably 20 PSI to 40 PSI of fuel supplied through passage 50 from the fuel supply 48. It should be noted that fuel may be supplied to the injector by any known manner utilizing any known type of metering principals. It should further be noted that the amount of fluid which flows into the timing chamber 32 (illustrated by arrow 74) is a function of the amount of fluid which flows to the metering chamber 34. As the injected fuel quantity is varied, thus increasing the volume of fuel in the metering chamber 34, the upper volume or volume of timing fluid within the timing chamber 32 will decrease in that the lower plunger section is free to float within the bore 12. As soon as the downward stroke of the upper plunger 26 has proceeded far enough to close off passage 56, the fluid metered into the timing chamber 32 will form a fixed length, hydraulic link (assuming the timing fluid to be substantially incompressible) between the upper plunger section 26 and the lower plunger section 28. This position being illustrated in FIG. 1B. Further downward movement of the upper plunger section 26 and lower plunger section 28 causes the now pressurized fuel in the metering chamber 34 to pass through passage 16 and displace the tip valve element 20 against the force the tip valve spring 22 in order to permit flow to pass through the orifice 14 in the direction of arrow 84.

Figure 2A:
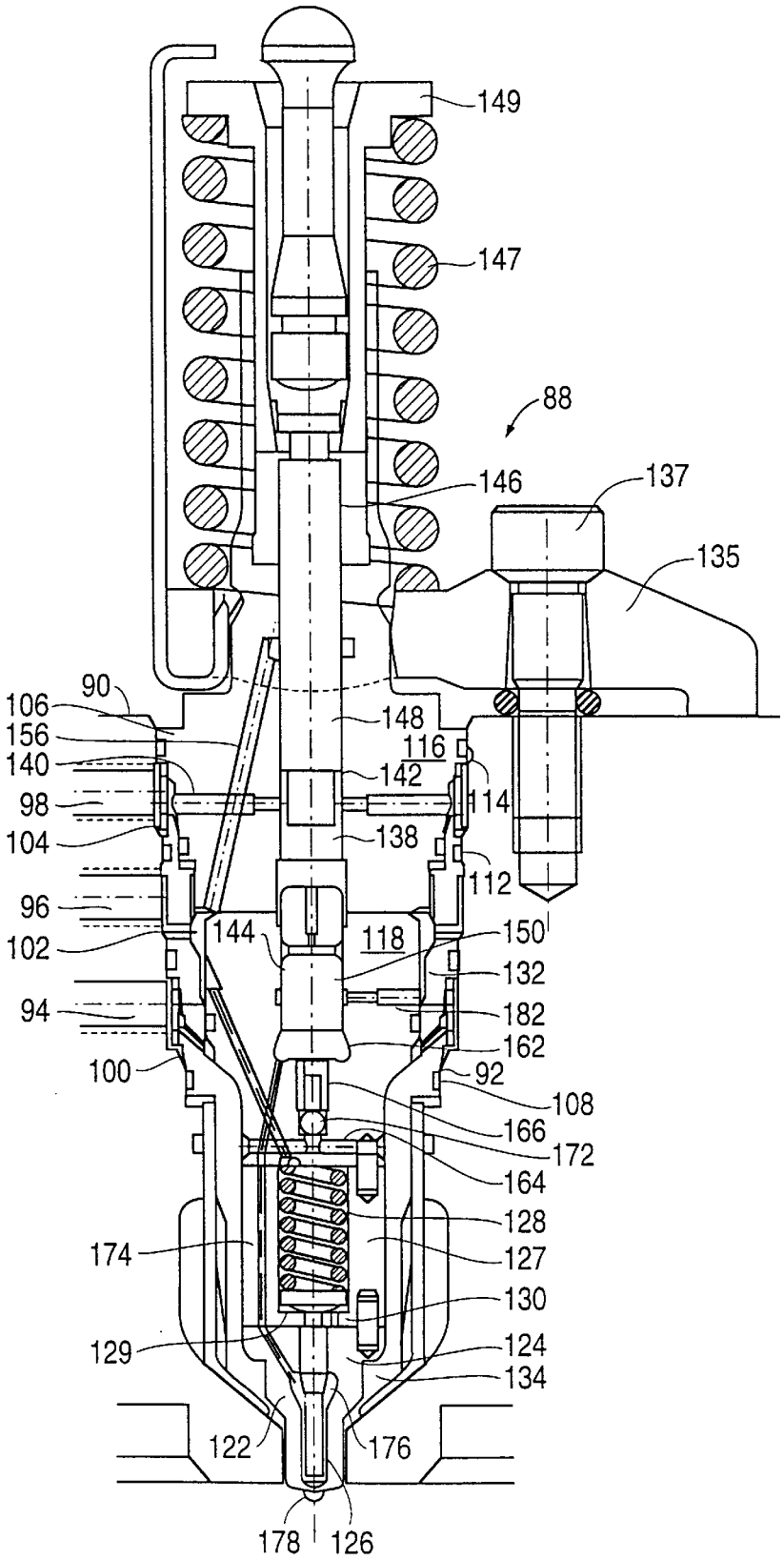
FIG. 2A is cross sectional view of a preferred injector design incorporating the principle features of the injector as illustrated in FIGS. 1A–1C in its fully retracted position.
Figure 2B:
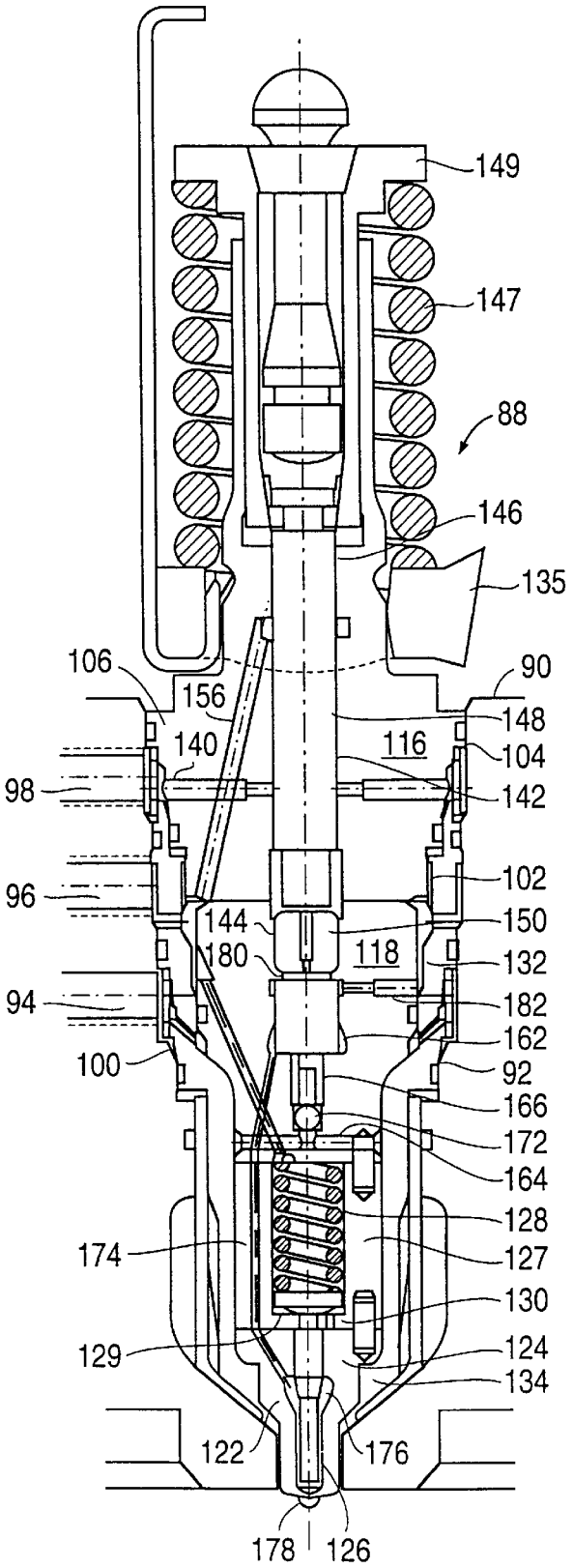
FIG. 2B is a cross-sectional view of the injector of FIG. 2A in its fully extended position.

The injection event terminates when the drain passage 40 formed in the lower plunger section 28 reaches the drain passage 76 formed in the injector body 10 as illustrated in FIG. 1C. At this point, the lower plunger section 28 is adjacent the bottom of the metering chamber 34. In doing so, continued downward movement of the upper plunger section 26 does not affect further downward movement of the lower plunger section 28. Further, with past injectors, the lower plunger section 28 may tend to bounce back upon impact with the bottom the metering chamber 34 resulting in an uneven cut off of fuel injection. With previous devices, this affect was compensated for by placing a slight compression bump on the injector actuating cam, however, this solution places very high compression loads on the entire cam operating actuating mechanism and would lead to excessive wear on the system. With the claimed invention, the need for a compression bump is eliminated in that the tendency of the lower plunger section 28 to bounce upwardly is compensated for due to the release of pressure in the timing chamber through the drain passages 40 and 76. Further, by providing a throttling section in passage 40 (as illustrated in FIGS. 2A and 2B) the timing fluid remains pressurized thus maintaining the lower plunger section 28 in a stable position. Once the upper plunger section 26 has reached its lower most position, the upper plunger section 26 will again ascend to the position illustrated in FIG. 1A where timing fluid will again be directed to the timing chamber 38 and fuel will be directed to the metering chamber 34. With the addition of fuel to the injection chamber under pressure, the lower plunger section 28 will be displaced upwardly again closing off the communication between drain passage 40 and drain passage 76. Once in this position, a subsequent injection event can take place.

Referring now to FIGS. 2A and 2B, the concept injection cycle illustrated in FIGS. 1A through 1C will be described in detail in conjunction with a TP type unit fuel injector. FIGS. 2A and 2B illustrate cross sectional views of a more detailed practical embodiment of a unit fuel injector employing the inventive features described with reference to the schematic illustrations of FIGS. 1A through 1C. The injector assembly 88 is illustrated as positioned in an engine head 90 containing a recess 92 for receiving the injector assembly. Recess 92 is intersected at axially spaced locations by three internal flow paths including a fuel supply flow path 94, a drain flow path 96 and a timing fluid flow path 98. Again, it should be noted that fluid for each of the flow paths 94 and 98 may come from the same source. Each of these flow paths may be formed by drilling out a single bore which intersects with each of a plurality of injector receiving recesses and a multi cylinder engine. The various flow paths remain fluidically isolated by the provision of seal means which fluidically isolate three annular flow chambers 100, 102 and 104 of recess 92 surrounding the exterior surface of the injector body 106. Seals 108, 110, 112 and 114 are in the form of 0-ring seals and are positioned in corresponding recesses formed in the injector body 106. O-ring seals 108 and 110 cooperate to define flow chamber 100 for interconnecting flow path 94 with the fuel injector assembly 88. Similarly, 0-ring 110 and 0-ring 112 cooperate to define a second annular flow path for interconnecting the drain flow path 96 with the injector assembly 88 while 0-ring seal 112 cooperates with 0-ring 114 to define annular flow chamber 104 for interconnecting the timing fluid flow path 98 with the injector assembly 88.

The injector body 106 is formed of multiple components including an upper injector barrel 116, a lower injector barrel 118 and a tip nozzle assembly 122. As illustrated in FIGS. 2A and 2B, the tip nozzle assembly 122 includes a tip nozzle housing 124 containing an axial bore for receiving a tip valve element 126 (corresponding to valve element 20 of FIGS. 1A through 1C), a tip valve spring housing 127 containing a cavity for receiving a tip valve spring 128, a spring seat 129 connected to the upper end of the tip valve element 26 and a nozzle stop 130 positioned between the tip nozzle housing 124 and the spring housing 126. A cup shaped injector assembly retainer 132 is arranged to hold the upper injector barrel 116, the lower barrel 118, the valve spring housing 127, the nozzle stop 130 and the tip nozzle 124 in an axially stacked and tight engagement, a lower interned radial flange 134 at the lower end of the injector assembly retainer 132 engages a shoulder on an exterior tip of the nozzle housing 124 and an internal thread on the inside of the injector assembly retainer 132 engages an exterior thread on the lower portion of the upper injector barrel 116 to allow the entire assembly to be held in tight engagement. The injector assembly 88 is normally held in position by a clamp 135 which is held in place by bolt 137 as illustrated in FIG. 2A.

Timing fluid under pressure from flow path 98 is transferred to the timing chamber 138 through a radial timing passage 140 formed in the upper injector barrel 116 between annular flow chamber 104 and the upper central bore section 142 contained in the upper injector barrel 116. The lower injector barrel 118 contains a lower central bore section 144 aligned with the upper central bore section 142. A plunger assembly 146 received in the upper and lower central bore sections 142 and 144 includes an upper plunger section 148 and a lower plunger section 150 corresponding to elements 26 and 28 of FIGS. 1A through 1C. In addition, the plunger assembly 146 includes a plunger spring 147 connected with the upper plunger section 148 by a plunger spring retainer 149 for biasing the upper plunger section 148 in an upward direction. A leakage passage 156 extends axially and radially downwardly from a position opening into the upper central bore section 142 adjacent the upper plunger section 148 and flows into the annular flow chamber 102. This is provided such that any leakage around the upper plunger section 148 may be passed to the drain.

Fuel enters a metering chamber 162 through radially extending fuel supply passage 164 and passes a check valve 172 positioned in the axial flow passage 166. Pressurized fuel which is pressurized in the metering chamber 162 is discharged through an injection passage 174 where the fuel is transferred to an injection chamber 176 thereby unseating the tip valve 126 and permitting fuel to pass through the orifices 178 and into a respective engine cylinder.

The injector assembly 88 operates on a cyclic basis in response to rotation of the cam on a cam shaft of the internal combustion engine incorporating such injector assembly. With reference to FIG. 2A, the plunger assembly 146 is illustrated in its initial position wherein the upper plunger section 148 is in its uppermost position permitting communication between the timing fluid passage 140 and the timing chamber 138. Similarly, the lower plunger portion 150 is displaced to the position shown in FIG. 2A due to the pressure of supply fuel being supplied through the passages 164 and 166 to the metering chamber 162. As discussed hereinabove, the lower plunger section 150 is free to float within the central bore 144 and is displaced upwardly in accordance with the amount of fuel dispensed to the metering chamber 162. After the dwell period has passed in the cam profile, the upper plunger section 148 is displaced downwardly thereby stopping communication between the timing fluid passage 140 and timing fluid chamber 138. At this point, a fixed hydraulic link is formed between the upper plunger section 148 and lower plunger section 150 thereby likewise displacing the lower plunger section 150 in a downward direction. In doing so, the metered fuel within the metering chamber 162 is pressurized and passed through the passage 174 into the injection chamber 176 wherein the tip valve 126 is displaced permitting injection of fuel through the orifice 178 into the respective cylinders of the internal combustion engine. Once the lower plunger section 150 is displaced to the position illustrated in FIG. 2B, the radial passage 180 formed in the lower plunger section 150 communicates with drain passage 182 formed in the lower injection barrel 118 so as to disperse fluid trapped between the upper plunger section 148 and lower plunger section 150 through the drain passage 96. Once the upper plunger section 148 has reached its bottom dead center position, it will once again be retracted to the position illustrated in FIG. 2A thereby opening the timing fluid supply passage and permitting the timing fluid chamber 138 to be filled with fluid while the metering chamber 162 is likewise filled with a metered amount of fuel prior to the commencement of any subsequent injection cycle. Again, bouncing of the lower plunger section 150 is avoided by throttling the fluid from the timing chamber 138 and maintaining pressure above the lower plunger section 150.

As noted hereinabove, during the descent of the upper plunger section 26 as illustrated in FIG. 1A, the closing of the timing fluid passage 56 is carried out at the same time during each injection cycle, thus resulting in a constant start of injection. That is, the hydraulic link between the upper plunger section 26 and the lower plunger section 28 is formed at the same time during each injection cycle.

Figure 3A:
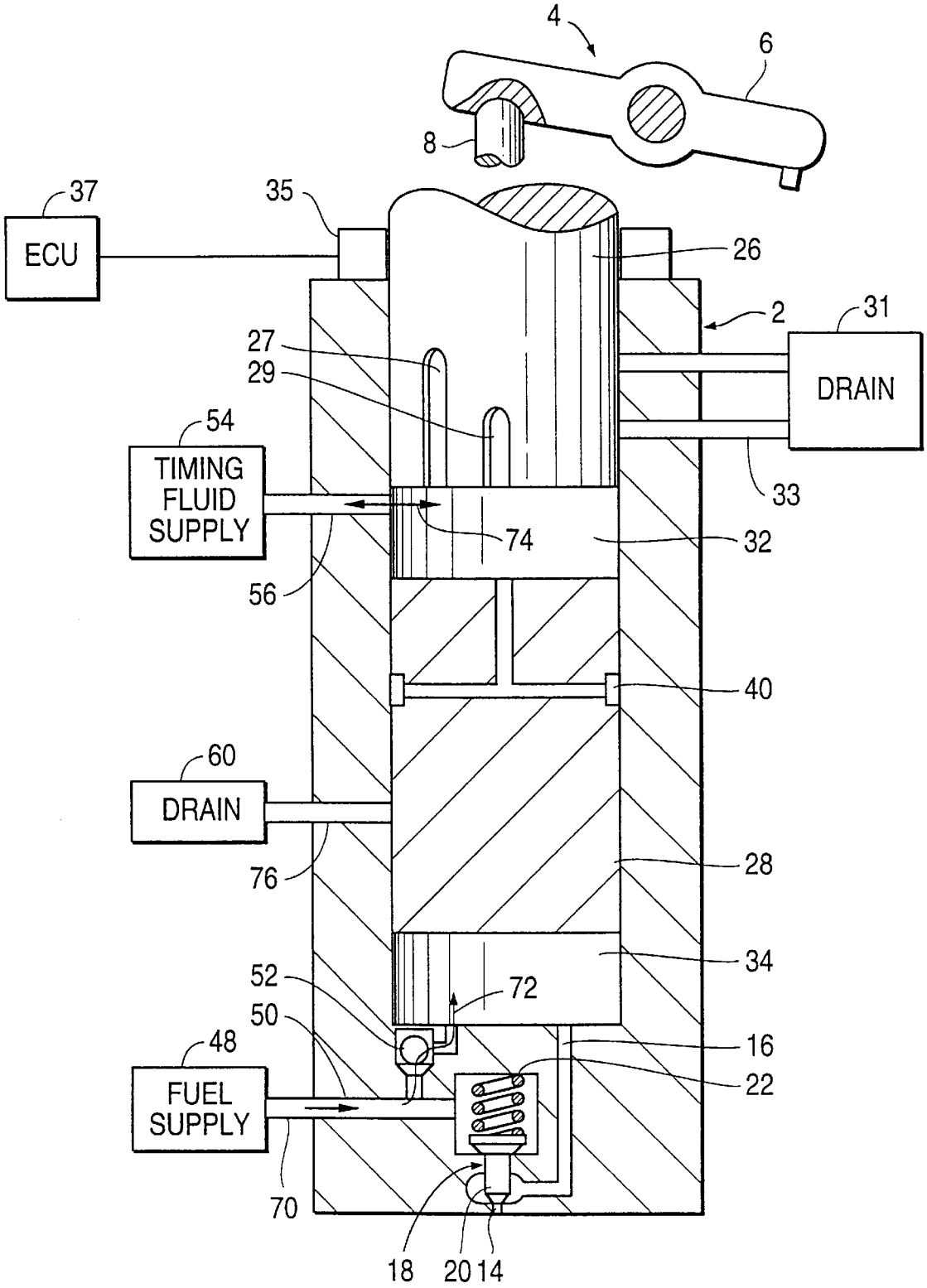
FIG. 3A is a cross sectional, schematic view of a fuel injector constructed in accordance with an alternative embodiment the subject invention including a cam actuated upper plunger section depicted in its uppermost position to allow fuel and timing fluid to flow into the injector.
Figure 3B:
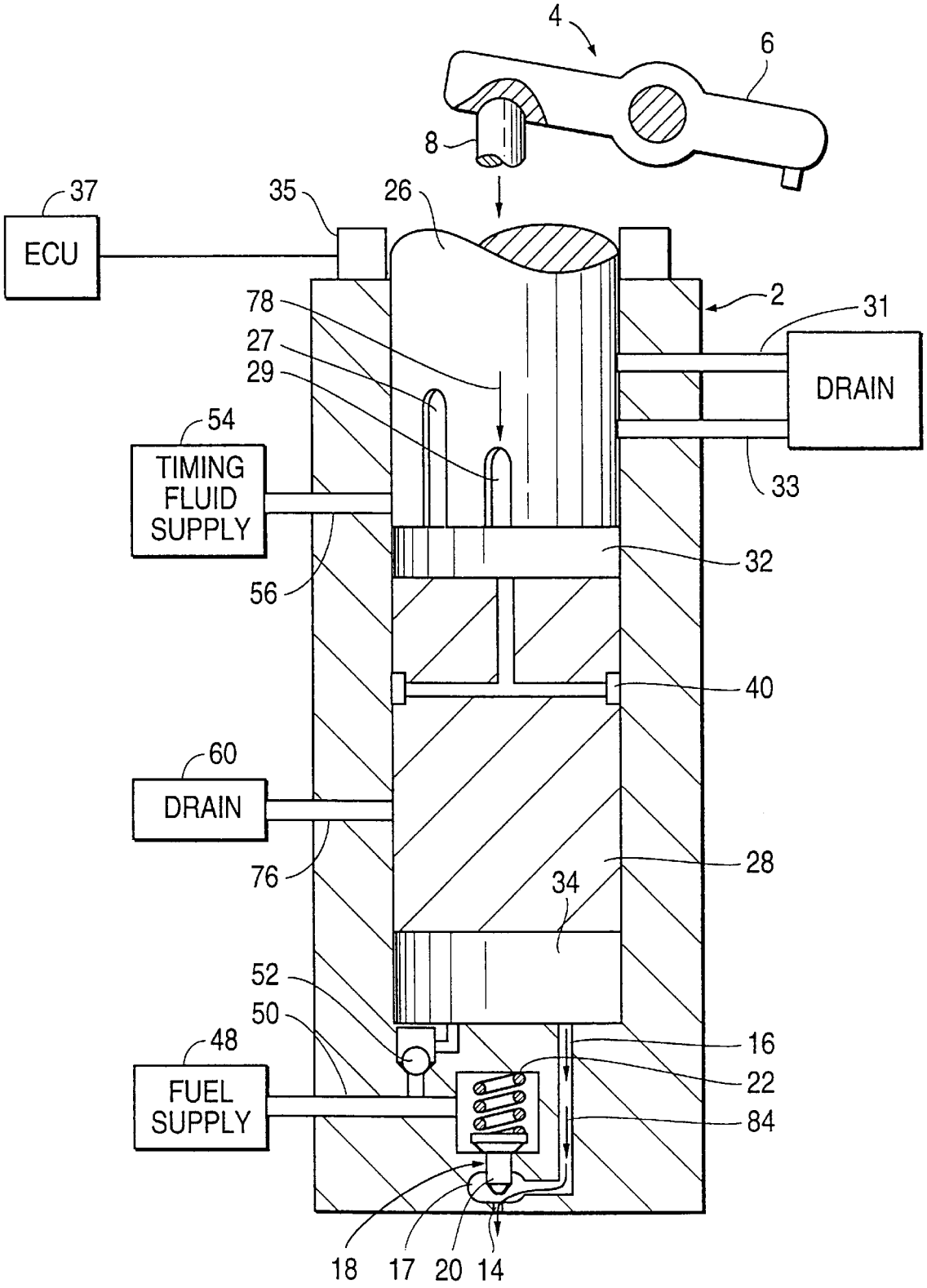
FIG. 3B is a cross sectional view of the injector illustrated in FIG. 3A wherein the upper plunger section has commenced a downward stroke to cause fuel metered into the metering chamber to be dispelled through the injector orifice.
Figure 3C:
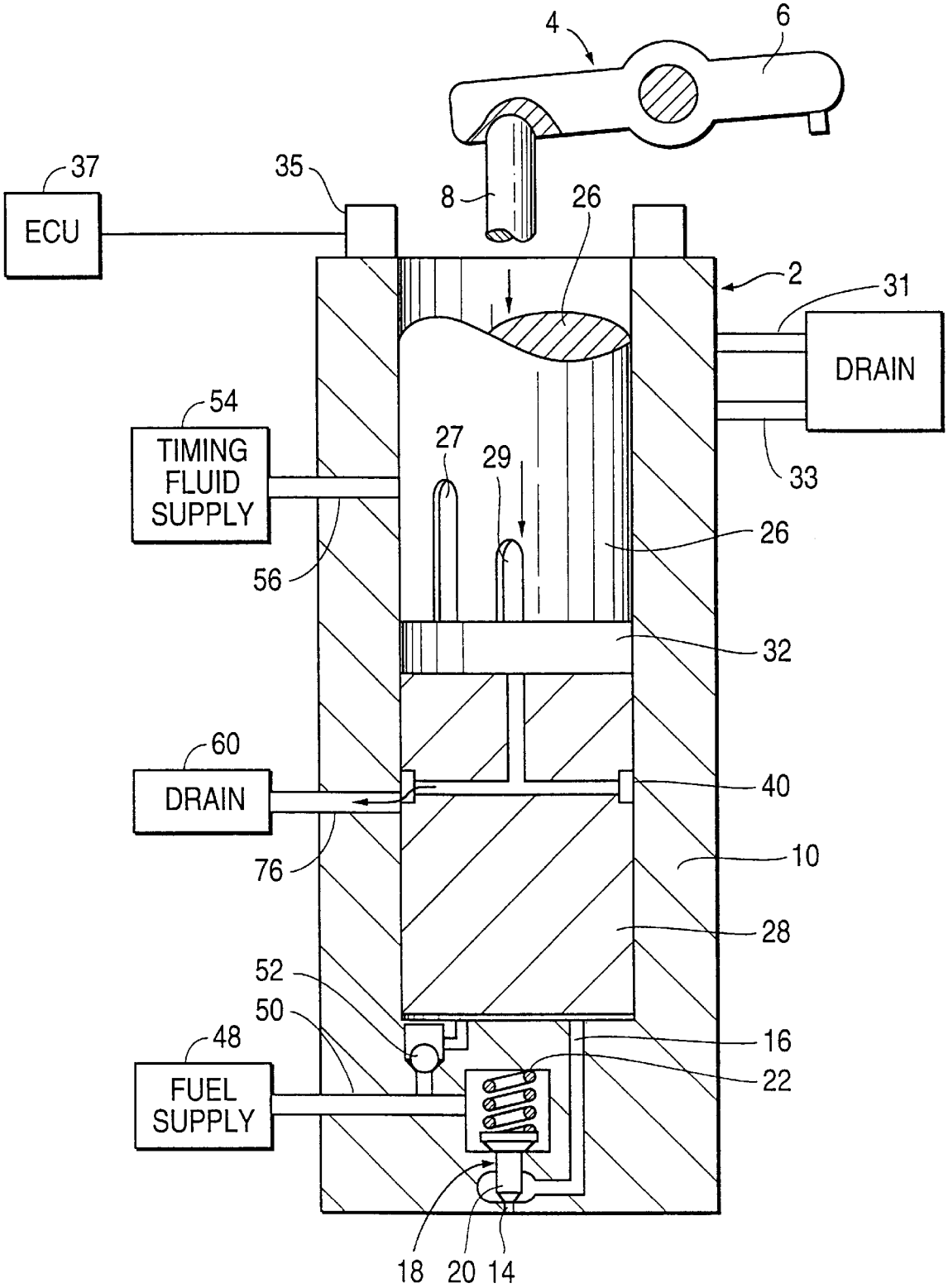
FIG. 3C is a cross sectional view of the injector illustrated in FIGS. 3A and 3B including a lower plunger section which has reached its lowermost position during the downward stroke of the upper plunger section and the timing fluid remaining in the timing chamber is being dispelled through a drain passage.

Referring now to FIGS. 3A through 3C, an alternative to the embodiment discussed hereinabove wherein the constant start of injection may be varied between a selected number of constant start of injection points will be discussed in greater detail.

Referring now to FIG. 3A wherein like elements will be described using the same reference numerals as referred to hereinabove with respect the previous embodiment illustrated in FIG. 1A, a schematic illustration of a unit fuel injector 2 is set forth wherein the upper plunger section 26 includes a plurality of grooves 27 and 29 which may be aligned with one of the drain passages 31 and 33 in order to alter the timing of the initial formation of the hydraulic link between the upper plunger section 26 and the lower plunger section 28. In order to achieve the selection of the appropriate groove and thus the appropriate point where injection is to be commenced, a rotation mechanism 35 is provided about the upper plunger section 26 which permits the upper plunger section to be rotated thus aligning a selected groove with its respective drain passage. The mechanism 35 for rotating the upper plunger section 26 may be of any known type such as a rack-and-pinion or other similar device. Further, the position of the upper plunger section 26 may be readily controlled by a electronic control unit 37 which utilizes engine operating characteristic to determine the appropriate positioning of the upper plunger 26 and thus the appropriate timing of the constant start of injection. With this in mind, the operation of the unit fuel injector illustrated in FIG. 3A is carried out in accordance with that set forth hereinabove. Particularly, when the upper plunger section 26 is in the position illustrated in FIG. 3A, timing fluid is passed to the timing fluid chamber 32 by way of passage 56 while at the same time, fuel from the fuel supply 48 is supplied to the metering chamber 34 as discussed hereinabove. Again, this is carried out during a dwell in the movement of the upper plunger section 26. Once an appropriately metered amount of fuel is supplied to the metering chamber 34, continued rotation of the cam will cause downward movement of the upper plunger section 26, thus closing off the timing fluid supply passage 56. It should be noted, however, that upon rotation of the upper plunger section 26, thus aligning one of the grooves 27 and 29 with an adjacent drain passage 31 and 33, the constant start of injection during the downward stroke of the upper plunger section 26 would be delayed until a uppermost limit of the groove 27 or 29 has passed its respective drain passage. Accordingly, while the constant start of injection is delayed, such injection will still occur at a constant time throughout the injection cycle unless and until the upper plunger section is again rotated by the rotation mechanism 35 in response to a signal received from the electronic control unit 37. Once in the position illustrated in FIG. 3B, downward movement of the lower plunger section 28 is commenced, thus increasing the pressure of the fuel within the metering chamber 34 thereby forcing the pressurized fuel through the passage 16 to the injection chamber 17 to be expelled through the injection orifice 14 and into a respective cylinder of the internal combustion engine.

Referring to FIG. 3C, continued downward movement of the upper plunger section 26 and consequently the lower plunger section 28 results in an alignment of the fluid passage 40 with drain passage 76, thus relieving the pressure of the fluid within the timing chamber 32 and eliminating the hydraulic link formed between the upper plunger section 26 and lower plunger section 28. With this release of pressure, continued downward movement of the upper plunger section 26 does not result in further movement of the lower plunger section 28 and thus the tip valve 20 is reseated thereby closing the orifice 14 and stopping the injection of fuel into the cylinder of the internal combustion engine. Again, once the upper plunger section 26 has reached its bottom dead center, upward movement of the upper plunger section 26 will permit fuel to be supplied to the metering chamber 34, thus elevating the lower plunger section 26 commensurate with the amount of fuel metered to the metering chamber 34.

It should be noted that while two axially extending grooves and two corresponding drain passages are provided, any practical number of grooves and corresponding drain passages may be provided. Further, a helical groove may be provided in the upper plunger resulting in infinitely variable constant start of injection positions.

Figure 4A:
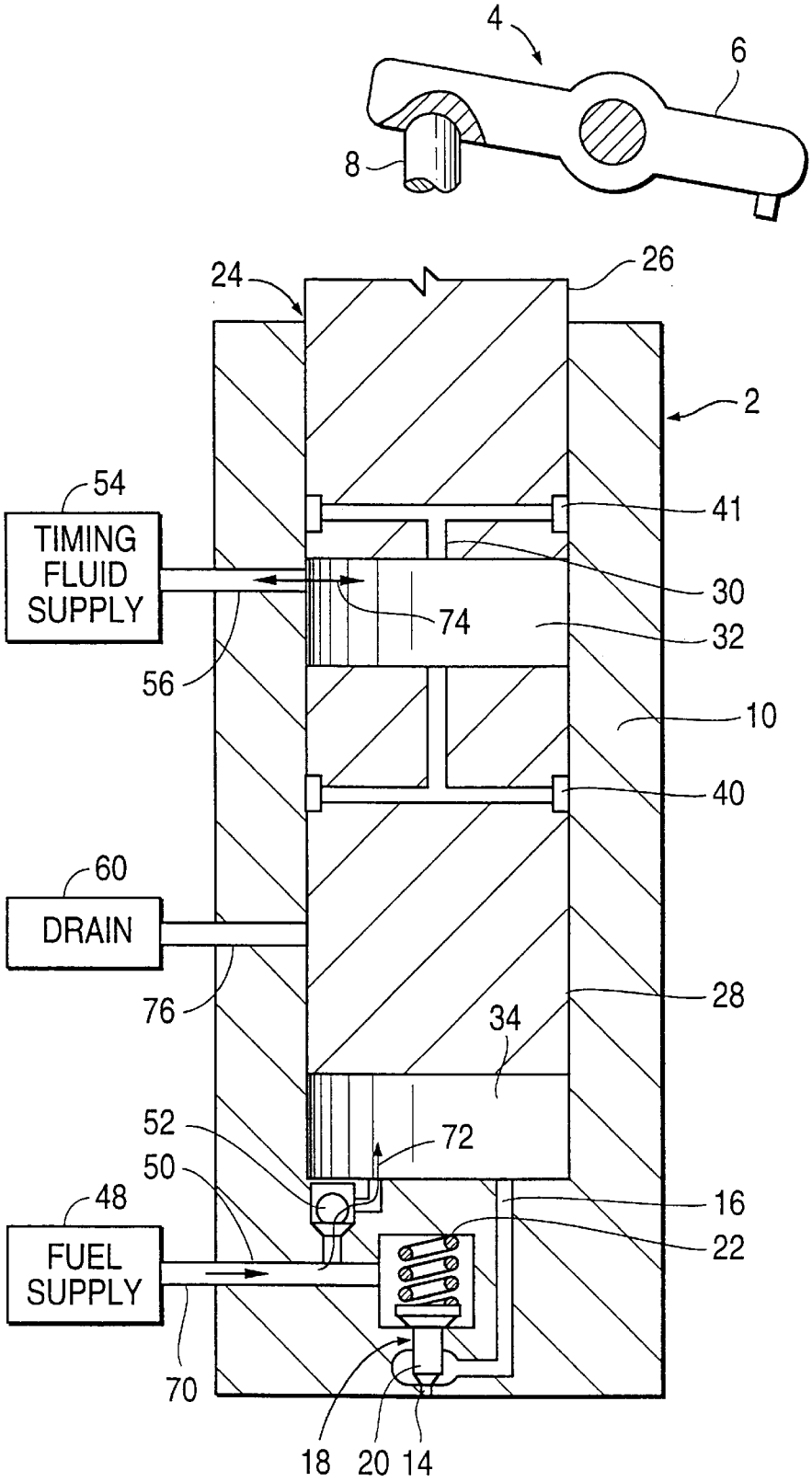
FIG. 4A is a cross sectional, schematic view of a fuel injector constructed in accordance with an alternative embodiment the subject invention including a cam actuated upper plunger section depicted in its uppermost position to allow fuel and timing fluid to flow into the injector.
Figure 4B:
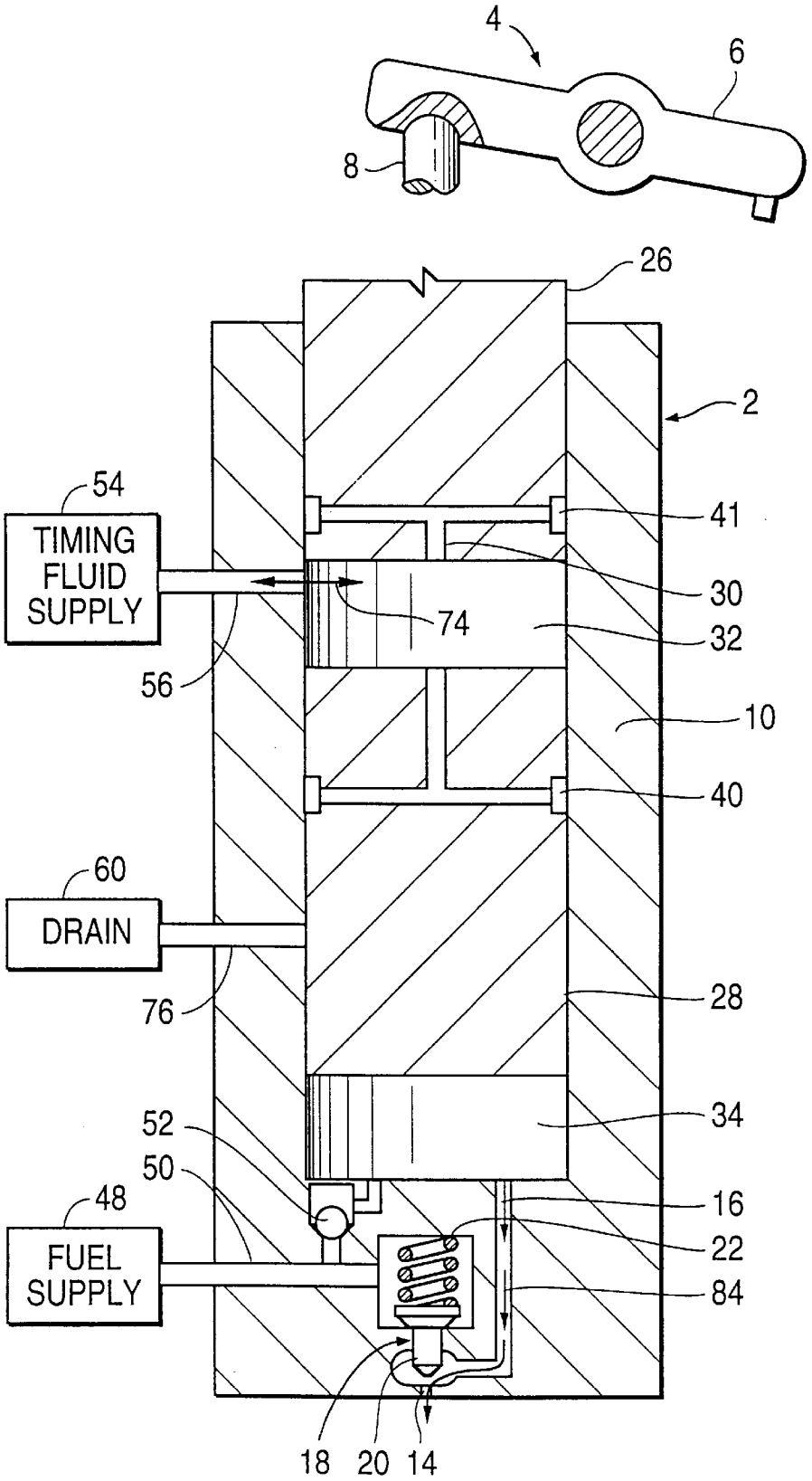
FIG. 4B is a cross sectional view of the injector illustrated in FIG. 4A wherein the upper plunger section has commenced a downward stroke to cause fuel metered into the injection chamber to be dispelled through the injector orifice.
Figure 4C:
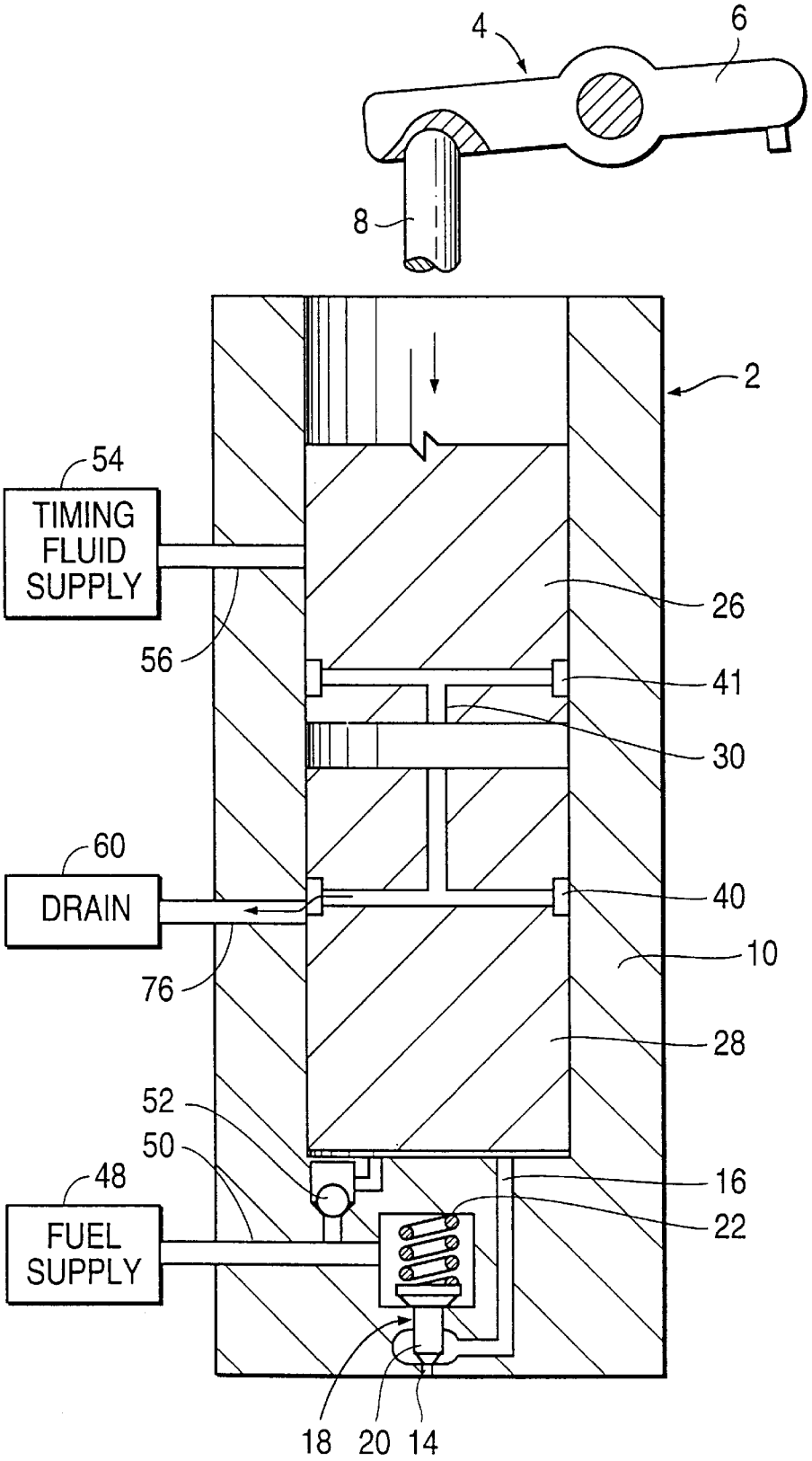
FIG. 4C is a cross sectional view of the injector illustrated in FIGS. 4A and 4B including a lower plunger section which has reached its lowermost position during the downward stroke of the upper plunger section and the timing fluid remaining in the timing chamber is being dispelled through a drain passage.

Referring now to FIGS. 4A through 4B, yet another embodiment of the present invention is illustrated wherein the unit injector 2 is provided with pilot injection. Again, the unit injector 2 illustrated in FIGS. 4A through 4C is substantially identical to that set forth in FIGS. 1A through 1C with the inclusion of an axial passage 30 and a radial passage 41 being formed in the upper plunger section 26. With the formation of these cooperating passages, the initial constant start of injection is temporarily interrupted when the radial passage 41 is aligned with the timing fluid passage 56 until the radial passage 41 passes the timing fluid passage 56. That is, during the downward stroke of the upper plunger section 26, injection is initially commenced when the lower most portion of the upper plunger section 26 passes and closes off communication between the timing fluid chamber 32 and the timing fluid supply 54. In this position, as is illustrated in FIG. 4B, downward movement of the lower plunger section 28 is commenced thus initiating injection of fuel pressurized in the metering chamber 34 through the passage 16 and orifice 14 and into a respective cylinder of the internal combustion engine. However, continued downward movement of the upper plunger section 26 results in the alignment of the radial passage 41 formed in the upper plunger section 26 with timing fluid passage 56 which permits fluid within the timing fluid chamber 32 to pass through the axial passage 30, through the radial passage 41 and into the timing fluid passage 56. This interruption results in the momentary stopping of the downward movement of the lower plunger section 28 and thus a momentary stoppage in the injection of fuel into the respective cylinder of the internal combustion engine. Continued downward movement of the upper plunger section 26 again closes off communication between the timing fluid chamber 32 and the timing fluid supply 54 resulting in continued injection of fuel into the respective cylinder of the internal combustion engine. The remaining fuel within the metering chamber 34 is thus expelled into the engine cylinder until the fluid passage 40 aligns with drain passage 76 resulting in the stoppage of further downward movement of the lower plunger section 28. Once the upper plunger section has reached bottom dead center, the upper plunger section is retracted, thus permitting fuel to be supplied to the metering chamber 34 displacing the lower plunger section 28 upwardly and ultimately permitting timing fluid to be supplied to the timing fluid chamber 32 prior to commencement of a subsequent injection cycle. While the pilot injection feature has been illustrated as including axial and radial bores formed in the upper plunger section 26, this pilot injection sequence may be carried out in any known manner wherein a momentary interruption in the injection of fuel into the cycle of the internal combustion engine is achieved.

As can be seen from the foregoing discussion, the present invention provides for a constant start of injection as the fuel quantity and engine speed is changed. Further, the foregoing invention results in a simple system wherein timing control strategy is carried out in a simple manner by permitting the constant start of injection without the pressure waves experience in a fuel injection system utilizing a distributor or valve type arrangement for initiating a constant start of injection.

While the present invention has been described with reference to referred embodiments, it will be appreciated by those skilled in the art that the invention may be practiced otherwise than as specifically described herein without departing from the spirit and scope of the invention. Therefore, it will be understood that the spirit and scope of the invention be limited only by the appended claims.

INDUSTRIAL PLICABILTY

The fuel injector design described hereinabove is capable of achieving accurate and independent control over fuel metering while providing a constant start of injection by means of a simple and easily manufactured injector. Such injectors are useable on a broad range of internal combustion engines, particularly of the compression ignition type. A particularly appropriate application of the subject injector design would be for a small compression ignition engine suitable for light trucks, automobiles, or other types of vehicles, as well as large internal combustion engines and stationary power plant applications.

We claim:

1. A fuel injector for periodically injecting fuel of a variable quantity on a cycle to cycle basis at a constant time during each injection cycle, comprising:

an injector body containing a central bore and an injector orifice at the lower end of the body;

a reciprocating plunger assembly including an upper plunger section and a lower plunger section serially mounted within said central bore;

a variable volume metering chamber located between said lower plunger section and the lower end of said injector body containing said injection orifice, said variable volume metering chamber communicating during a portion of each injection cycle with a source of fuel with the fuel supplied to the variable volume metering chamber being completely injected through said injector orifice during each injection cycle, and a variable volume timing chamber located between said upper and lower plunger sections, said timing chamber communicating for a portion of each injector cycle with the source of timing fluid, with said lower plunger being freely movable independently of a positioning of said upper plunger in the absence of a fluid pressure in said metering chamber and said timing chamber, wherein said lower plunger section includes a fluid drain passage extension communicating at one end with said timing chamber and at the other end with said fuel drain passage when said lower plunger section is adjacent its lowermost position within said central bore.

2. A fuel injector as defined by claim 1 for injecting fuel into a cylinder of an internal combustion engine having a piston reciprocating within the cylinder and a cam-operated injector actuating mechanism reciprocally moving in a predetermined phase relationship with the reciprocating piston, wherein said upper plunger section is adapted to be reciprocated by the cam-operated injector actuating mechanism to cause said upper plunger section to reciprocate in a fixed phase relationship with the reciprocating piston in the cylinder into which fuel is being injected.

3. A fuel injector as defined by claim 1, wherein said injector body contains a timing fluid supply passage communicating at one end with the source of timing fluid and communicating at the other end with said timing chamber when said upper plunger section is adjacent its uppermost position within said central bore.

4. A fuel injector as defined by claim 3 for use with an internal combustion engine containing a fluid drain, wherein said injector body contains a timing fluid drain passage communicating at one end with the fluid drain and communicating at the other end with said timing chamber when said lower plunger section is adjacent is lowermost position within said central bore.

5. A fuel injector as defined by claim 3, wherein said injector body contains a fuel supply passage communicating at one end with the fuel supply and communicating at the other end with said metering chamber.

6. A fuel injector as defined by claim 1, wherein said fluid drain passage extension includes a radial portion and an axial portion.

7. A fuel injector as defined in claim 1, wherein said injector body includes an upper barrel, a lower barrel, a nozzle assembly, and an assembly retainer means for connecting said upper barrel, said lower barrel and said nozzle assembly into a single unit.

8. A fuel injector as defined in claim 7, wherein said nozzle assembly includes a tip valve moveable between an open position in which said injection orifice is open and a closed position in which said injection orifice is closed and a nozzle spring for biasing said tip valve toward said closed position but permitting said tip valve to move to said open position whenever the fuel pressure within said metering chamber reaches a predetermined level.

9. A fuel injector as defined in claim 1, wherein fuel injection is commenced when said upper plunger section closes off fluid communication between a source of timing fluid and said variable volume timing fluid chamber.

10. A fuel injector as defined in claim 9, further comprising a closure varying means for varying a position of a portion of said upper plunger which closes off fluid communication between said source of timing fluid and said variable volume timing fluid chamber.

11. A fuel injector as defined in claim 10, wherein said closure varying means includes a plurality of axially extending grooves formed in a surface of said upper plunger section, a corresponding number of drain passages formed in said injector body and selection means for aligning one of said grooves with a respective one of said drain passages.

12. A fuel injector as defined in claim 1, further comprising interruption means for momentarily interrupting the injection of fuel through said orifice.

13. A fuel injector as defined in claim 12, wherein said interruption means includes a fluid passage formed in said upper plunger section for momentarily communicating said timing fluid chamber with a source of timing fluid after injection has commenced.

14. A unit fuel injector for periodically injecting fuel of a variable quantity on a cycle-to-cycle basis, comprising:

an injector body containing a central bore and an injection orifice at the lower end of the body;

metering means for metering a variable quantity of fuel for injection through said injection orifice on a periodic basis dependent upon the pressure of fuel supplied to said injector body, said metering means including a lower plunger section mounted for reciprocal movement within said central bore, said lower plunger being freely movable independently of a position of an upper plunger in the absence of fluid pressure acting on said lower plunger; and hydraulic timing means for initiating injection of metered fuel independent of the pressure of timing fluid supplied to said injector body, said hydraulic timing means including said upper plunger section mounted for reciprocal movement within said central bore and a timing fluid chamber formed in said injector body, wherein said injection is initiated at a constant time from cycle-to-cycle.

15. A fuel injector as defined by claim 14 wherein said injector body contains a timing fluid supply passage communicating at one end with the source of timing fluid and communicating at the other end with said timing chamber when said upper plunger section is adjacent its uppermost position within said central bore.

16. A fuel injector as defined by claim 15 for use with an internal combustion engine containing a fluid drain, wherein said injector body contains a timing fluid drain passage communicating at one end with the fluid drain and communicating at the other end with said timing chamber when said lower plunger section is adjacent is lowermost position within said central bore.

17. A fuel injector as defined by claim 16, wherein said injector body contains a fuel supply passage communicating at one end with the fuel supply and communicating at the other end with said metering chamber.

18. A unit fuel injector as defined in claim 14, wherein said lower plunger section includes a fluid drain passage extension communicating at one end with said timing fluid chamber and at another end with a drain passage when said lower plunger section is adjacent its lowermost position within said central bore.

19. A fuel injector as defined by claim 18 wherein said fluid drain passage extension includes a radial portion and an axial portion.

20. A fuel injector as defined in claim 14, wherein fuel injection is commenced when said upper plunger section closes off fluid communication between a source of timing fluid and said variable volume timing fluid chamber.

21. A fuel injector as defined in claim 20, further comprising a closure varying means for varying a position of a portion of said upper plunger which closes off fluid communication between said source of timing fluid and said variable volume timing fluid chamber.

22. A fuel injector as defined in claim 21, wherein said closure varying means includes a plurality of axially extending grooves formed in a surface of said upper plunger section, a corresponding number of drain passages formed in said injector body and selection means for aligning one of said grooves with a respective one of said drain passages.

23. A fuel injector as defined in claim 14, further comprising interruption means for momentarily interrupting the injection of fuel through said orifice.

24. A fuel injector as defined in claim 23, wherein said interruption means includes a fluid passage formed in said upper plunger section for momentarily communicating said timing fluid chamber with a source of timing fluid after injection has commenced.

* * * * *